US008599090B2

(12) United States Patent
Yamaguchi et al.

(10) Patent No.: US 8,599,090 B2
(45) Date of Patent: Dec. 3, 2013

(54) WAVEGUIDE SLOT ARRAY ANTENNA APPARATUS

(75) Inventors: Satoshi Yamaguchi, Tokyo (JP); Tooru Takahashi, Tokyo (JP); Masataka Otsuka, Tokyo (JP); Hiroaki Miyashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 429 days.

(21) Appl. No.: 12/865,223

(22) PCT Filed: Feb. 28, 2008

(86) PCT No.: PCT/JP2008/053527

§ 371 (c)(1),
(2), (4) Date: Jul. 29, 2010

(87) PCT Pub. No.: WO2009/107216

PCT Pub. Date: Sep. 3, 2009

(65) Prior Publication Data

US 2010/0321265 A1 Dec. 23, 2010

(51) Int. Cl.
*H01Q 13/10* (2006.01)

(52) U.S. Cl.
USPC ..... 343/770; 343/700 MS; 343/767

(58) Field of Classification Search
USPC ..... 343/700 MS, 767, 770, 792.5
See application file for complete search history.

(56) References Cited

U.S. PATENT DOCUMENTS 5,579,019 A * 11/1996 Uematsu et al. ..... 343/771
5,977,924 A * 11/1999 Takei et al. ..... 343/770

(Continued)

FOREIGN PATENT DOCUMENTS

JP 60 127011 8/1985
JP 3-141706 6/1991

(Continued)

OTHER PUBLICATIONS

Extended Search Report issued Sep. 19, 2011 in European Patent Application No. 08712098.6/2249437.

(Continued)

*Primary Examiner* — Shawki S Ismail
*Assistant Examiner* — Christopher Lo
(74) *Attorney, Agent, or Firm* — Oblon, Spivak, McClelland, Maier & Neustadt, L.L.P.

(57) ABSTRACT

Provided is a waveguide slot array antenna apparatus having a polarized wave plane in a direction oblique to a tube shaft of a waveguide, in which an excitation distribution of opening portions for radiating or receiving electromagnetic waves is appropriately attained. The waveguide slot array antenna apparatus includes a waveguide slot array antenna formed of a rectangular antenna waveguide which has a rectangular section orthogonal to a tube axis, in which: the rectangular antenna waveguide has one end side thereof in a tube axial direction serving as a feeding port and another end side short-circuited; the antenna waveguide has a plurality of slender rectangular opening portions for radiating or receiving an electromagnetic wave arranged at intervals of about λg/2 (λg is an intra-tube wavelength) along the tube axis on a first wide plane of a pair of wide planes that are parallel to the tube axis; the plurality of slender rectangular opening portions each have the same predetermined angle with respect to a center line parallel to the tube axis of the first wide plane; the opening portions adjacent to one another are alternately arranged at opposite positions with respect to the center line; the opening portions located on one side with respect to the center line of the first wide plane each have a length longer than about λf/2 (λf is a free space wavelength), and the opening portions located on another side each have a length shorter than about λf/2.

7 Claims, 15 Drawing Sheets

(56) References Cited

U.S. PATENT DOCUMENTS

| | | | | |
|---|---|---|---|---|
| 6,107,964 | A | 8/2000 | Hirabe | |
| 2002/0008665 | A1 | 1/2002 | Takenoshita | |
| 2005/0146478 | A1 * | 7/2005 | Wang et al. | 343/771 |
| 2006/0187122 | A1 * | 8/2006 | Noro et al. | 343/700 MS |
| 2008/0266195 | A1 * | 10/2008 | Yamaguchi et al. | 343/771 |

FOREIGN PATENT DOCUMENTS

| | | |
|---|---|---|
| JP | 4-12704 U | 1/1992 |
| JP | 9 64637 | 3/1997 |
| JP | 3008891 | 12/1999 |
| JP | 2000-236213 | 8/2000 |
| JP | 2001 196850 | 7/2001 |
| JP | 2001 339207 | 12/2001 |
| JP | 2003 152441 | 5/2003 |
| JP | 2003-318648 | 11/2003 |
| JP | 2004-15460 | 1/2004 |
| JP | 3812203 | 6/2006 |
| JP | 2007 67581 | 3/2007 |
| JP | 2007 259047 | 10/2007 |
| WO | 99 56346 | 11/1999 |
| WO | 2006 092862 | 9/2006 |

OTHER PUBLICATIONS

Sembiam R. Rengarajan, "Compound Coupling Slots for Arbitrary Excitation of Waveguide-Fed Planar Slot Arrays", 8082 IEEE Transactions on Antennas and Propagation, XP 000102944, vol. 38 No. 2, Feb. 1, 1990, pp. 276-280.

Sembiam R. Rengarajan, "Compound Broad-Wall Slots for Array Applications", 8082a IEEE Antennas and Propagation Magazine, XP 000169287, vol. 32, No. 6, Dec. 1, 1990, pp. 20-26.

Rajeek, A. Mohammed et al., "Analysis of a Wide Compound Slot-Coupled Parallel Waveguide Coupler and Radiator", IEEE Transactions on Microwave Theory and Techniques, vol. 43, No. 4, pp. 802-809, (Apr. 1995).

Japanese Office Action issued Jul. 31, 2012, in Patent Application No. 2010-500491 (with English-language translation).

* cited by examiner (a)

(b)

(a)

(b)

(a)

(b)

(a)

(b)

(a)

(b)

WAVEGUIDE SLOT ARRAY ANTENNA APPARATUS

TECHNICAL FIELD

The present invention relates to a waveguide slot array antenna apparatus, and more particularly to a waveguide slot array antenna apparatus having a polarized wave plane in a direction oblique to a tube axis of a waveguide.

BACKGROUND ART

There has been known a waveguide slot array antenna apparatus in which a large number of slots parallel to the tube axis are alternately arranged at intervals of about ½ intra-tube wavelength with respect to the center line of a waveguide wide plane in the tube axial direction of the waveguide. Because an electric field is generated in the width direction of the slot, the polarized wave plane of the antenna is orthogonal to the tube axis.

Meanwhile, a waveguide slot array antenna having the polarized wave plane in a direction oblique to the tube axis of the waveguide is disclosed in, for example, Patent Document 1. In the waveguide slot array antenna, slot elements are alternately arranged at intervals of about ½ intra-tube wavelength in the tube axial direction across the center line of the waveguide wide plane, and the respective slot elements are inclined at given angles with respect to the tube axis, to thereby radiate linearly polarized waves in a direction oblique to the tube axis.

Patent Document 1 discloses an arrangement position of the slots and the inclined angles of the slots, but neither discloses nor suggests the selection of the length and width of the slots. In particular, the length of the slots influences the resonance characteristic and the excitation distribution of the waveguide slot array antenna, and its selecting method is important.

Patent Document 1: JP 9-64637 A

Patent Document 2: JP 2001-196850 A (FIG. 4, FIG. 5)

DISCLOSURE OF THE INVENTION

Problem to be Solved by the Invention

An example of the characteristic of the waveguide slot array antenna disclosed in Patent Document 1 is disclosed in FIGS. 4 and 5 of the Patent Document 2 by the same inventors, from which it is found that the radiation pattern shape according to the configuration of Patent Document 1 has a remarkably large side robe on a plane including the tube axis of the waveguide (see FIG. 4 of Patent Document 2), and also the main beam direction is shifted by about 20 degrees from the antenna front direction on a plane orthogonal to the tub axis (FIG. 5 in Patent Document 2).

In general, in order to obtain the maximum gain of the antenna, it is desirable that the side robe level of the antenna be as low as possible. Further, the main beam direction of the antenna is generally directed toward the front side for use. In view of this, it is necessary to design the waveguide slot array antenna so that the excitation distributions (excitation amplitude and the excitation phase) of the respective slots may be appropriately set. The disturbance of the excitation distribution induces asymmetry of the radiation pattern shape, deterioration of the side robe level, and displacement in the main beam direction, resulting in the disturbance of the radiation pattern shape, which remarkably deteriorates the antenna gain.

The present invention has been made to solve the above problem, and an object of the present invention is to provide a waveguide slot array antenna apparatus having a polarized wave plane in a direction oblique to a tube shaft of a waveguide, in which an excitation distribution of slots that radiate or receive electromagnetic waves is appropriately attained.

Means for Solving the Problem

The present invention resides in a waveguide slot array antenna apparatus including a waveguide slot array antenna formed of a rectangular antenna waveguide which has a rectangular section orthogonal to a tube axis, in which: the rectangular antenna waveguide has one end side thereof in a tube axial direction serving as a feeding port and another end side short-circuited; the antenna waveguide has a plurality of slender rectangular opening portions for radiating or receiving an electromagnetic wave arranged at intervals of about $\lambda g/2$ ($\lambda g$ is an intra-tube wavelength) along the tube axis on a first wide plane of a pair of wide planes that are parallel to the tube axis; the plurality of slender rectangular opening portions each have the same predetermined angle with respect to a center line parallel to the tube axis of the first wide plane; the opening portions adjacent to one another are alternately arranged at opposite positions with respect to the center line; the opening portions located on one side with respect to the center line of the first wide plane each have a length longer than about $\lambda f/2$ ($\lambda f$ is a free space wavelength), and the opening portions located on another side each have a length shorter than about $\lambda f/2$.

Effect of the Invention

According to the present invention, a length of slender rectangular opening portions for radiation or incidence such as slots of the waveguide is set to a length within a specific range so that the excitation distribution of the opening portions may be attained appropriately.

BEST MODES FOR CARRYING OUT THE INVENTION

Embodiment 1

Figure 1:
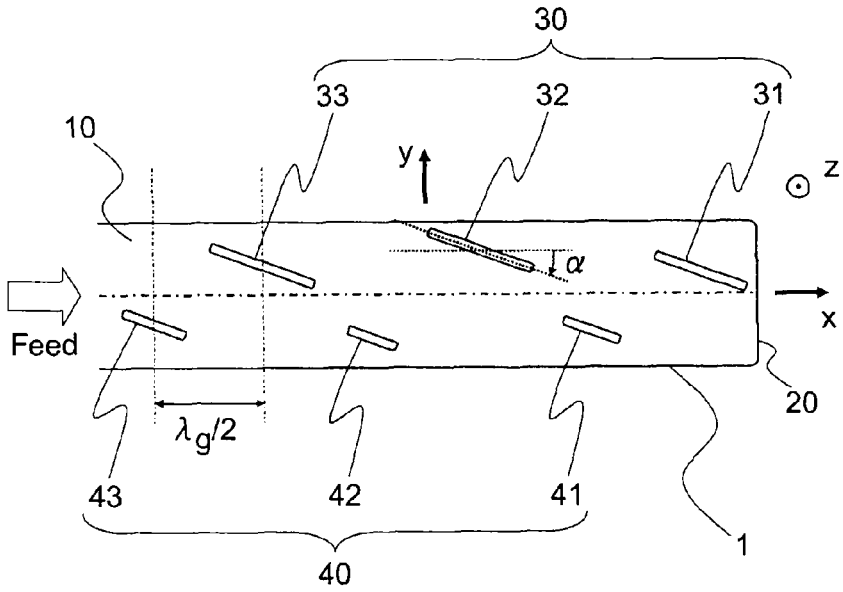
FIG. 1 is a diagram illustrating a configuration of a waveguide slot array antenna apparatus according to Embodiment 1 of the present invention.

FIG. 1 is a front view of a wide plane side provided with slots of a waveguide slot array antenna apparatus according to Embodiment 1 of the present invention. Referring to FIG. 1, an antenna waveguide 10, which is a waveguide a lot array antenna, is formed of a hollow metallic tube that has a rectangular section orthogonal to a tube axial direction. The wide plane illustrated in FIG. 1 is a plane corresponding to a long side of the rectangular section, and slot groups 30 and 40 for radiation or incidence are formed on one of a pair of opposed wide planes as illustrated in FIG. 1. One end of the waveguide 10 in the tube axial direction is covered with a short-circuiting plane 20, and the other end serves as a power feed port from which electricity is fed (indicated by the arrow "Feed"). For the sake of convenience, the tube axial direction of the waveguide 10 is defined as x-direction, a direction orthogonal to the tube axis of the waveguide on the wide plane formed with the slots is defined as y-direction, and a normal direction of the wide plane formed with the slots is defined as z-direction.

The slot groups 30 and 40 are formed of slots 31 to 33 and 41 to 43, respectively, which are slender rectangular opening portions formed in the wide plane of the waveguide 10. The slots 31 to 33 and 41 to 43 are obliquely inclined by an angle $\alpha$ in the same orientation with respect to the tube axis of the waveguide 10. The adjacent slots are alternately arranged at opposite positions with respect to a center line (indicated by the dashed line: tube axis=center line) parallel to the tube axis of the wide plane of the waveguide 10, at intervals of about $\lambda g/2$ or $\lambda g/2$ ($\lambda g$ is an intra-tube wavelength of a use electromagnetic wave within the waveguide). Further, there is a feature in that the slot group 30 is located on one side with respect to the center line of the waveguide 10 and the lengths of the slots 31 to 33 are longer than about $\lambda f/2$ or longer than $\lambda f/2$ ($\lambda f$ is a free space wavelength of the use electromagnetic wave). Further, there is a feature in that the slot group 40 is located on the other side different from the side of the slot group 30 with respect to the center line of the waveguide 10 and the lengths of the slots 41 to 43 are shorter than about $\lambda f/2$ or shorter than $\lambda f/2$. The waveguide 10, the short-circuiting plane 20, and the slot groups 30, 40 constitute the waveguide slot array antenna 1. In the following description, the wavelength means the free space wavelength $\lambda f$ of the use electromagnetic wave unless otherwise specified.

Figure 2:
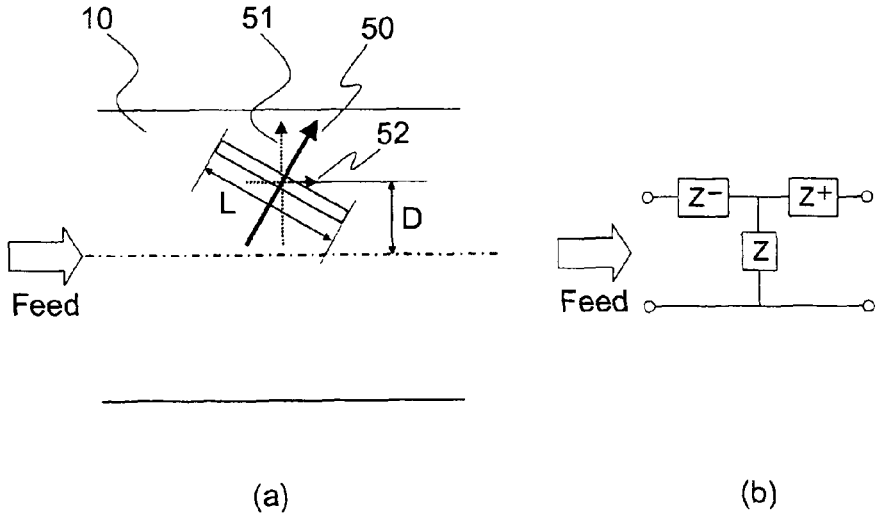
FIG. 2 are diagrams for illustrating an effect of the present invention.

Subsequently, the advantages of the present invention are described. FIG. 2(*a*) illustrates a diagram enlarging one of the slots formed in the waveguide 10 of the waveguide slot array antenna of FIG. 1, and FIG. 2(*b*) illustrates an equivalent circuit of the slot illustrated in FIG. 2(*a*). In FIG. 2(*a*), L represents a slot length, and D represents the offset amount of the slot center from the center line of the waveguide wide plane. Further, reference numeral 50 illustrates how a current instantaneously crosses the slot, 51 denotes a component of the current 50 in a tube width direction of the waveguide (component in a y-direction), and 52 denotes a component of the current 50 in a tube axial direction of the waveguide (component in an x-direction). Still further, FIG. 2(*b*) illustrates an equivalent circuit of the slot of FIG. 2(*a*). As described above, the equivalent circuit is illustrated as a T-type circuit, in view of dividing the current 50 into a tube width direction component 51 and a tube axial direction component 52. That is, it is assumed that a load Z contributes to the tube width direction component 51 of the current, and a load Z+ and a load Z− contribute to the tube axial direction component 52.

Figure 3:
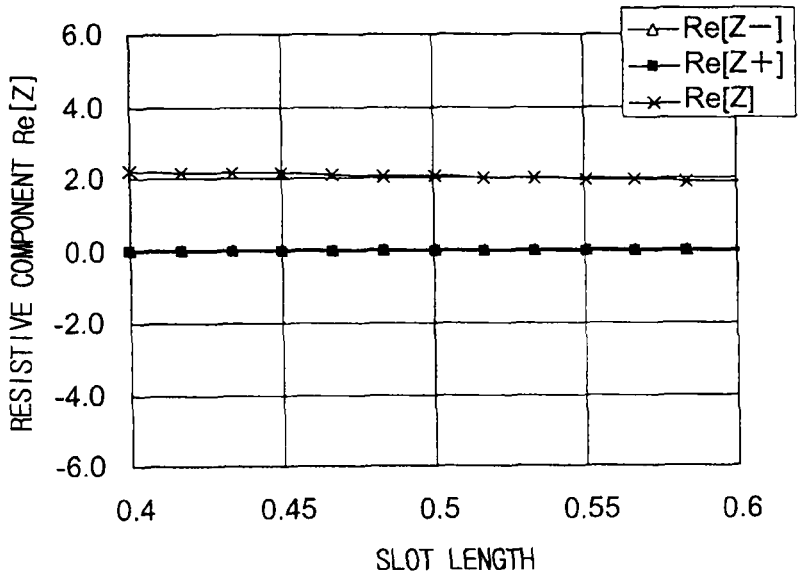
FIG. 3 are graphs illustrating calculation results based on an equivalent circuit of FIG. 2.
Figure 3:
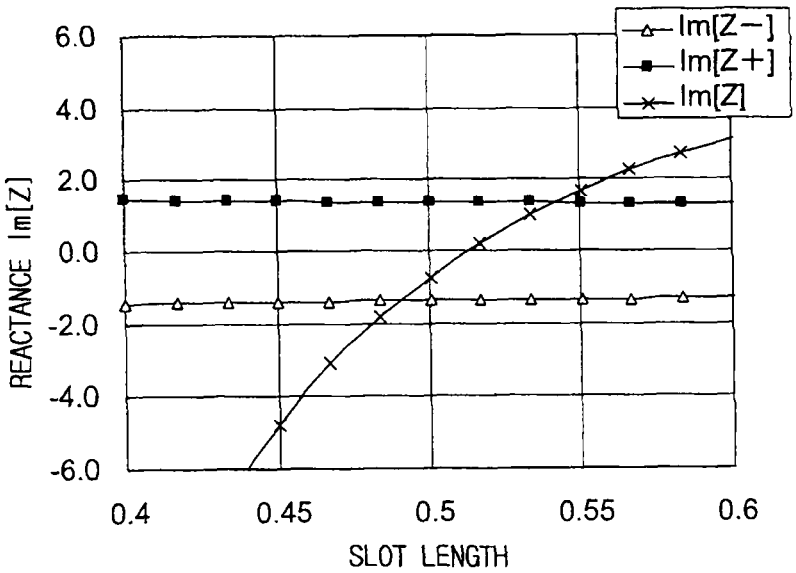
Figure 4:
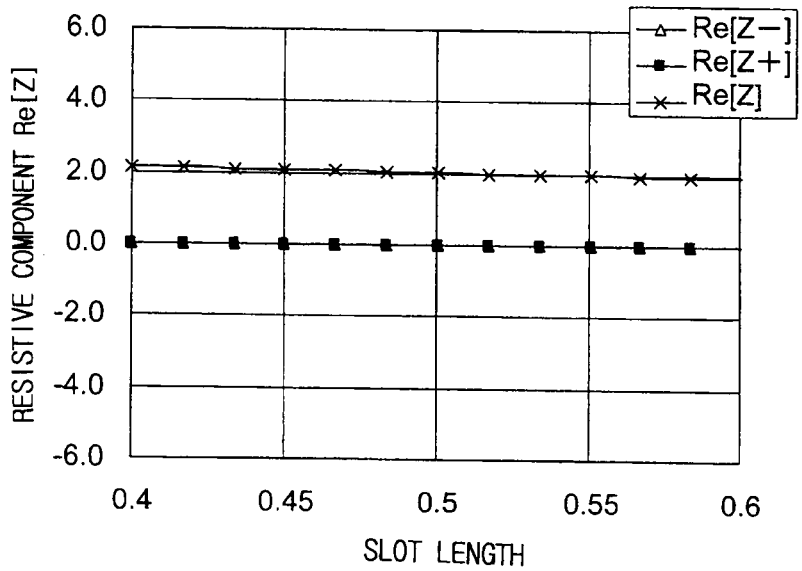
FIG. 4 are graphs illustrating calculation results based on the equivalent circuit of FIG. 2.
Figure 4:
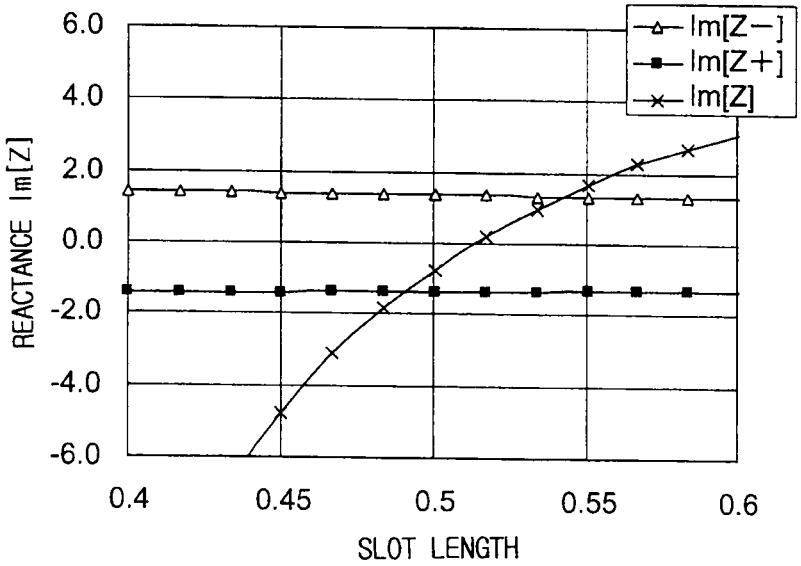

As an example, FIGS. 3 and 4 illustrate, in the design frequency of the X band, the calculation results of the T-type circuit impedance values (Z, Z+, Z−) when a slot element that is 0.04 wavelength in the slot width (direction orthogonal to the slot length L of FIG. 2(*b*)) and a rotating angle $\alpha$=45 degrees from the tube axis is disposed on a waveguide that is 0.76 wavelength (0.76 $\lambda f$, hereinafter the same) in waveguide A dimension (width) and 0.17 wavelength in waveguide B dimension (thickness). The finite element method is used for the calculation. FIG. 3 illustrate the results when the center of the slot is offset from the center line of the waveguide wide plane in the +y direction of the y direction by 0.17 wavelength (D=+0.17). FIG. 4 illustrate the results when the center of the slot is offset from the center line of the waveguide wide plane in the −y direction by 0.17 wavelength (D=−0.17).

In FIGS. 3 and 4, the abscissa axes of the graphs each represent a slot length ($L/\lambda f$) standardized by the wavelength $\lambda f$, the ordinate axes of FIGS. 3(*a*) and 4(*a*) each represent a real part (resistive component) of an impedance, and the ordinate axes of FIGS. 3(*b*) and 4(*b*) each represent an imaginary part (reactance component). The impedance value is a value (Z/Zg) standardized by a characteristic impedance Zg of the waveguide. In the following description, a sign of Re□ represents the extraction of the real part of the impedance, and Im□ represents the extraction of the imaginary part of the impedance.

First, in the real part of each impedance illustrated in FIGS. 3(*a*) and 4(*a*), it may be confirmed that Re[Z] is dominative, and Re[Z+] and Re[Z−] are substantially zero. Specifically, this means power consumption, that is, the radiation from the slot toward a space, is conducted by an impedance Z that contributes to a tube width direction component 51 of the current. Then, attention is paid to the imaginary part of each impedance illustrated in FIGS. 3(*b*) and 4(*b*). Im[Z+] and Im[Z−] indicate a constant value irrespective of a change in the slot length, and substantially have a relation of Im[Z+]=−Im[Z−]. Also, it is found that Im[Z] changes according to the slot length. Further, in this case, when the slot length may be set to about 0.52 wavelength, Im[Z] becomes zero, and Z is represented by only the resistive component. However, Z+ and Z− have the reactance component without becoming zero, and hence there is a feature in that the entire slot elements may not be pure resistive.

Figure 5:
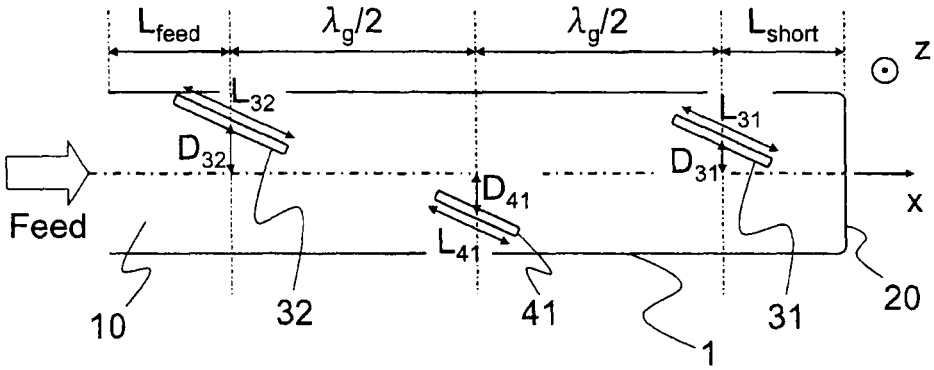
FIG. 5 are graphs diagrams illustrating how slot elements are arrayed, and an equivalent circuit thereof.
Figure 5:
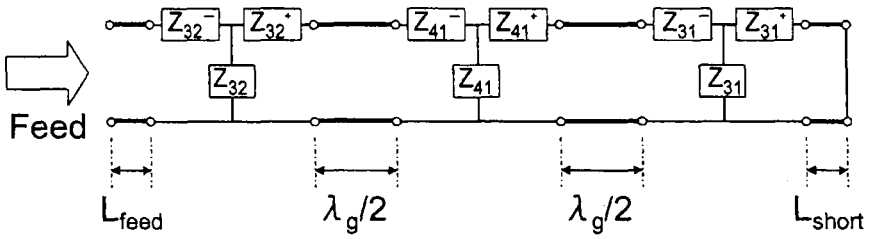

FIG. 5 illustrate how the slot elements are arrayed, and an equivalent circuit thereof. FIG. 5(*a*) illustrates a front view of the wide plane side provided with the slots of the waveguide, and FIG. 5(*b*) illustrates an equivalent circuit of the waveguide of FIG. 5(*a*). In the equivalent circuit of FIG. 5(*b*), the slot elements illustrated as the above-mentioned T-type circuit, the distances between the respective slots 32, 41, and 31 are represented by λg/2 (λg is an intra-tube wavelength within the waveguide of the use electromagnetic wave), a distance between the short-circuiting plane 20 and the slot 31 adjacent to the plane is represented by a distance $L_{short}$, a distance between a feeding point and the slot 32 adjacent to the feeding point is represented as a distance $L_{Feed}$, to thereby illustrate a distributed constant line of the waveguide, and the respective components are continuously connected to each other.

In order to excite the respective slots in phase, it is necessary to avoid phase shifting when the current passes through the slot portions. That is, in the current branch portion of the T-type circuit, a current flowing on the Z side and a current flowing on the Z+ side may be distributed in phase. In order to achieve this, Im[Z] and Im[Z+], which are the reactance components of the impedance, may have the same sign.

Figure 6:
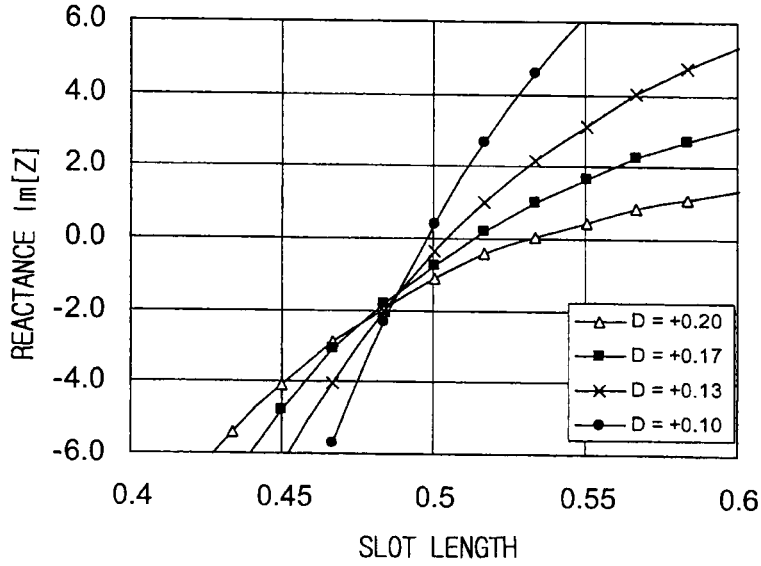
FIG. 6 are graphs illustrating values of Im[Z] and Im[Z+] with respect to a change in slot length when an offset amount D from a center line of a waveguide wide plane of each slot center is changed to different amounts in a direction +y in a slot element model of an X band.
Figure 6:
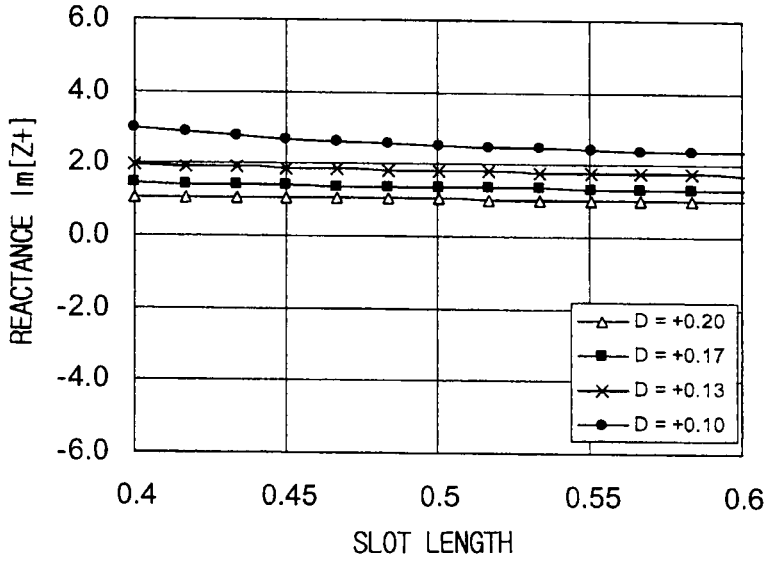
Figure 7:
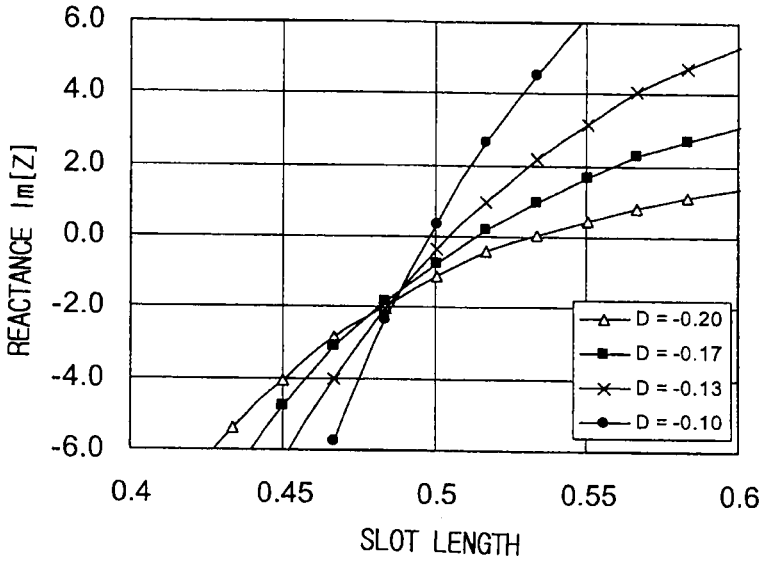
FIG. 7 are graphs illustrating values of Im[Z] and Im[Z+] with respect to a change in slot length when the offset amount D from the center line of the waveguide wide plane of each slot center is changed to different amounts in the direction −y in a slot element model of an X band.
Figure 7:
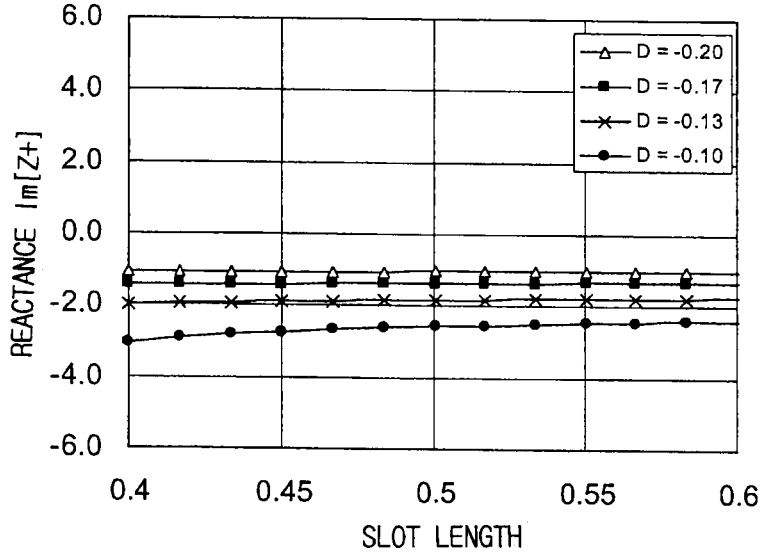

FIGS. 6(*a*) and 6(*b*) illustrate values of Im[Z] and Im[Z+] when the offset amount D from the center line of the waveguide wide plane of the slot center is changed by a different amount in the +y direction (D=+0.10, +0.13, +0.17, +0.20) with the axis of abscissa as the slot length standardized by the wavelength λf, in the slot element model of the above-mentioned X band, respectively. Likewise, FIGS. 7(*a*) and 7(*b*) are results of the values of Im[Z] and Im[Z+] when the offset amount D is changed by a different mount in the −y direction (D=−0.10, −0.13, −0.17, −0.20). According to this example, in the case where the offset amount D is changed in the +y direction, it is found from FIG. 6 that when the slot length is made longer than about 0.5 λf or longer than 0.5 λf, both Im[Z] and Im[Z+] have positive values (more strictly, equal to or lower than 0.53 λf, or equal to or higher than 0.7 λf). On the other hand, in the case where the offset amount D is changed in the −y direction, it is found from FIG. 7 that when the slot length is made shorter than about 0.5 λf or longer than 0.5 λf, both Im[Z] and Im[Z+] have negative values (more strictly, equal to or lower than 0.495 λf, or equal to or higher than 0.3 λf). As described above, the slot length is selected according to the offset amount D from the center line of the waveguide wide plane of the slot center, so that the phase shifting due to the slots may be avoided, to thereby obtain the uniform excitation phase distribution over the entire waveguide slot array antenna.

Figure 8:
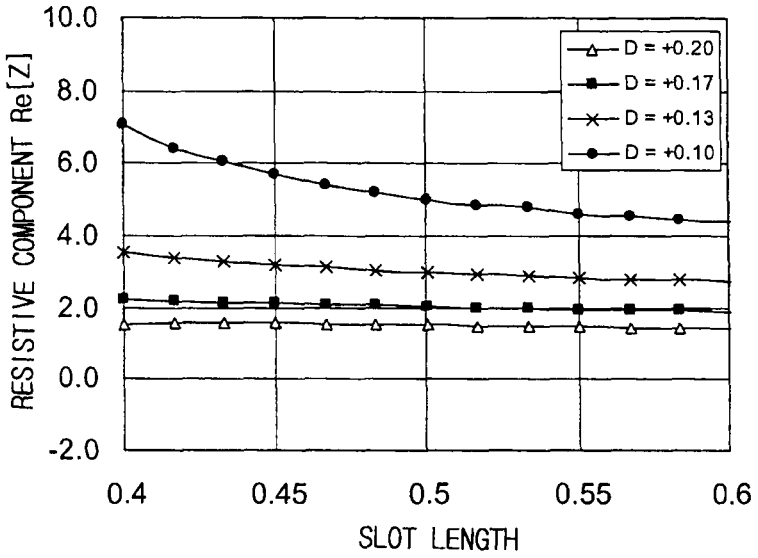
FIG. 8 is a graph illustrating a value of Re[Z] with respect to a change in the slot length when D is changed to a plurality of different amounts in a direction +y.

On the other hand, the antenna amplitude of the waveguide slot array antenna is determined according to the value of Re[Z] by which an electric power is mainly consumed. FIG. 8 illustrates the values of Re[Z] when D is changed by a plurality of different amounts in the +y direction (D=+0.10, +0.13, +0.17, +0.20).

When D is changed in in the −y direction, as is apparent from the relation between FIGS. 3 and 4, the absolute value of D has substantially the same value as that of FIG. 8. It is found from FIG. 8 that Re[Z] is dominated by an influence of the offset amount D from the center line of the waveguide wide plane of the slot center.

When it is assumed that a current flowing in the load Z is I, and its absolute value is |I|, a power consumption Power due to the load Z is represented by the following expression.

$$\text{Power}=Re[Z|I|^2]$$

Accordingly, when the array antenna illustrated in FIG. 5 is considered, the value of Z may be determined, with consideration given to that the amount of radiation (amplitude) from the respective slots to the space is represented by the above expression. For example, when all the excitation amplitudes of the respective slots are uniform, the value of Z may be selected so that all the power consumption values become identical with one another. Alternatively, when providing the amplitude distribution such as the Taylor distribution in order to provide the lower side robe, the above power consumption value may be set along a desired distribution value, and the value of Z may be selected.

Figure 9:
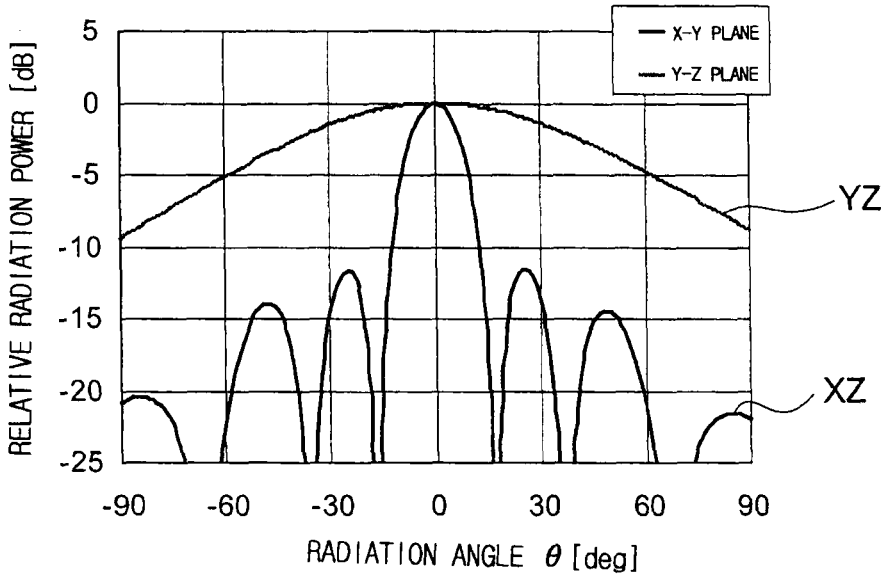
FIG. 9 is a graph illustrating a radiation pattern calculated value illustrated as an example of the effect of the present invention.

As an example of the effect of the present invention, FIG. 9 illustrates a radiation pattern calculation value when 5 (slot) element arrays are provided in the X-band model described above. In FIG. 9, the axis of abscissa represents a radiation angle θ, and the axis of ordinate represents a relative radiation power. The slot length L of the 5 element arrays and the offset amount D from the waveguide wide plane center line of the slot center are (L, D)=(0.52, +0.10), (0.48, −0.09), (0.57, +0.10), (0.46, −0.10), and (0.61, 0.11) in this order from the element closer to the short-circuiting plane 20 (in units of wavelength). Referring to FIG. 9, in the radiation pattern shapes of a plane (XZ plane) including the waveguide tube axial direction and a plane (YZ plane) orthogonal to the waveguide tube axis, the main beam is directed toward the front side and a symmetrical radiation pattern shape is obtained, and accordingly it is confirmed that the excitation distribution of the slots is uniform.

Embodiment 2

In the Embodiment 1 described above, the dimensions of the distance $L_{short}$ between the short-circuiting plane 20 of the antenna waveguide 10 and the center of the slot 31 adjacent to the short-circuiting plane 20 illustrated in FIG. 5 are not explicitly described. However, when the dimension of the above distance $L_{short}$ is set to an odd multiple of about λf/4 or an odd multiple of λf/4 on the leading end of the waveguide 10, the leading end is opened (OPEN) when viewed from the slot 31 side, and a standing wave that maximizes the waveguide tube wide direction component 51 of the current 50 at the positions of the slots 31 to 33 or of the slots 41 to 43 is generated in the waveguide 10. As a result, the power consumption at the respective slots, that is, the radiation amount from the respective slots to the space becomes maximum, so that the high antenna efficiency may be realized.

Embodiment 3

Figure 10:
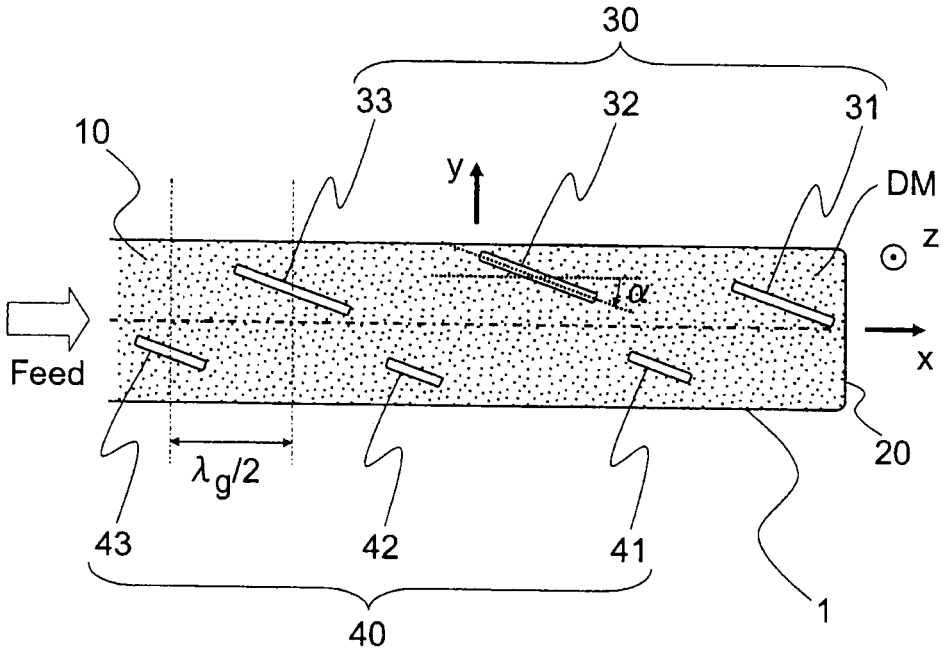
FIG. 10 is a diagram illustrating a configuration of a waveguide slot array antenna apparatus according to Embodiment 3 of the present invention.

In the above Embodiment 1 and Embodiment 2, a material of the interior of the waveguide 10 is not explicitly described. The waveguide 0 is formed of a metallic tube as described above, and the interior may be of a hollow structure. Alternatively, the interior of the metallic tube of the waveguide 10 may be filled with a dielectric material DM as illustrated in FIG. 10. In FIG. 10, the same as or corresponding parts to those in the above embodiments are denoted by identical reference symbols, and their description is omitted (hereinafter the same). When the waveguide 10 is filled with the dielectric material DM, there is obtained such an advantage that the intra-tube wavelength of the waveguide is shortened according to the specific permittivity of the dielectric material. As a result, the element intervals of the slots may be adjusted, which increases the degree of freedom of design of the array antenna.

Figure 11:
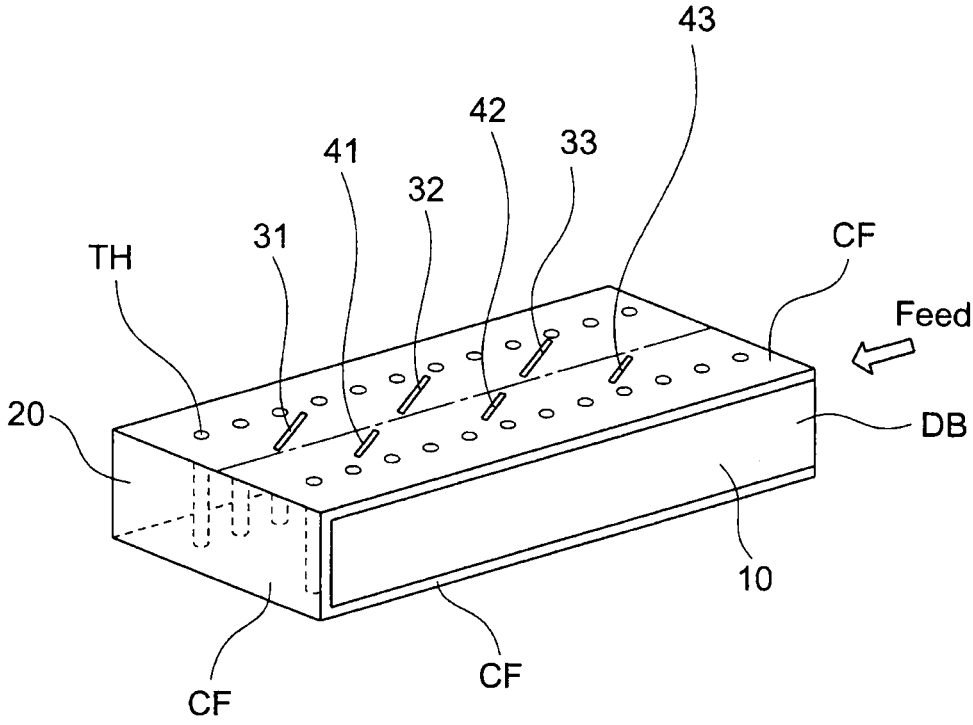
FIG. 11 is a diagram illustrating another configuration of the waveguide slot array antenna apparatus according to Embodiment 3 of the present invention.

Alternatively, in stead of using the hollow metallic tube, there may be employed, as illustrated in FIG. 11, a thick dielectric board DB which has a copper foil portion (copper foil layer) CF formed on the wide planes on both sides and the short-circuiting plane 20 thereof, and in which a large number of through-holes TH subjected to metal plating are formed on both sides of the center line of the wide plane so as to pass through the dielectric board DB and electrically connect the copper foil portions CF of the wide planes on both sides, to thereby form a waveguide wall in a pseudo manner. In addition, the slots 31 to 33 and 41 to 43 may be formed, to thereby form the antenna waveguide 10 that is a waveguide slot array antenna. The slots 31 to 33 and 41 to 43 (the same of applies to coupled slots of FIGS. 12 and 13 and coupled holes of FIG. 14, which are described later) which are slender rectangular opening portions for radiation or incidence are defined by grooves obtained by scraping off the copper foil of the copper foil portion CF on the dielectric board DB. As a result, the waveguide slot array antenna 1 may be realized easily and inexpensively by using the conventional board processing technology and etching technology.

It is needless to say that the waveguide with the structures described above may be also applied to the waveguide slot array antenna (antenna waveguide, antenna joint waveguide) and to the feeding waveguide according to the respective embodiments.

Embodiment 4

Figure 12:
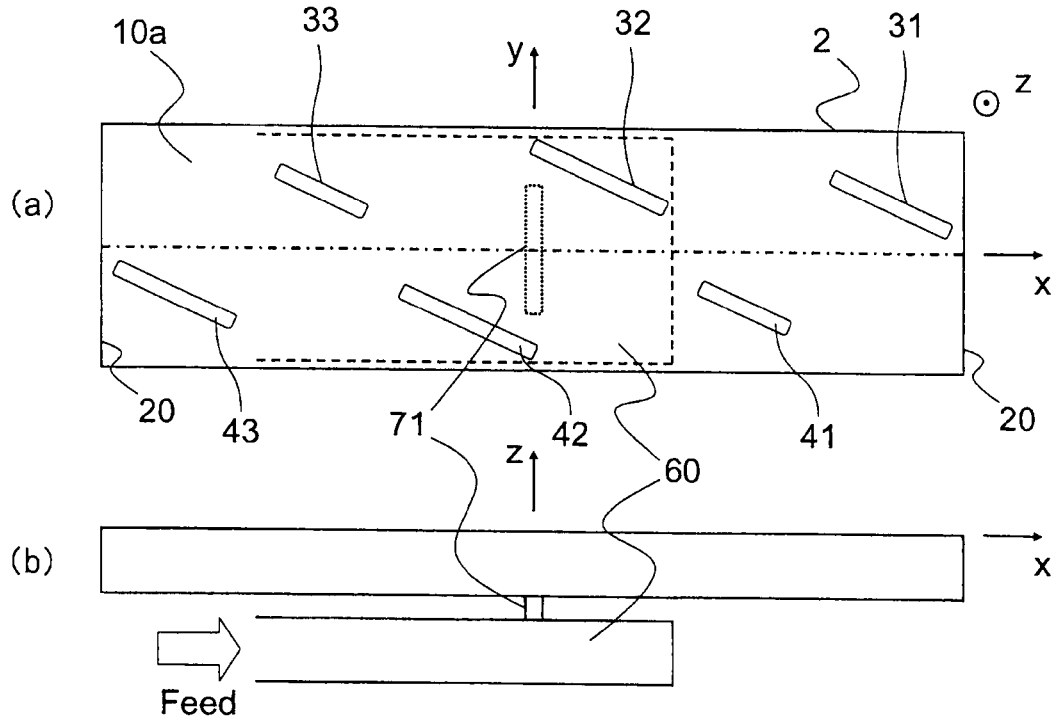
FIG. 12 are diagrams illustrating a configuration of a waveguide slot array antenna apparatus according to Embodiment 4 of the present invention.

FIG. 12 are diagrams illustrating a configuration of a waveguide slot array antenna apparatus according to Embodiment 4 of the present invention. FIG. 12(*a*) is a front view thereof on the wide plane side on which slots are formed, and FIG. 12(*b*) is a bottom view of FIG. 12(*a*). Reference numeral 2 denotes a waveguide slot array antenna whose both ends are short-circuited, which is configured by an antenna joint waveguide 10*a*. The antenna joint waveguide 10*a* includes two kinds of antenna waveguides 10 forming the waveguide slot array antenna 1 illustrated in FIGS. 1 and 5, which are joined together in the opposite directions with the tube axes thereof being aligned, at the positions of the respective feeding points, and has both ends short-circuited on the short-circuiting planes 20. The feeding points are provided between the adjacent slots. Further, a feeding waveguide 60 is disposed on a rear side (one of the pair of wide planes which has no slots formed therein) of the waveguide slot array antenna 2 whose both ends are short-circuited. The waveguide slot array antenna 2 whose both sides are short-circuited and the feeding waveguide 60 are coupled (connected) with each other via a coupling portion configured by a coupling slot (coupling opening portion) 71 formed in the respective members so as to overlap with each other, and electricity is fed from the feeding waveguide 60 to the waveguide slot array antenna 2 whose both ends are short-circuited. As illustrated in FIGS. 12(*a*), 14(*a*), and 16(*a*), a coupling tube that connects between the coupling slots 71 may be included. In this way, the waveguides may be multilayered to configure the waveguide slot array antenna apparatus.

In FIG. 12, when viewed from the coupling slot 71 of the waveguide slot array antenna 2 whose both ends are short-circuited, the number of the slots 31 to 33 for radiation or incidence formed on one side of the coupling slot 71, which is 3, is equal to the number of the slots 41 to 43 for radiation or incidence formed on another side of the coupling slot 71. However, the number of the slots for radiation or incidence does not need to be always identical between the sides, and may be different from each other. Also, the position of the coupling slot 71 may not be always in the center of the tube axial direction of the waveguide slot array antenna 2 whose both ends are short-circuited.

Figure 13:
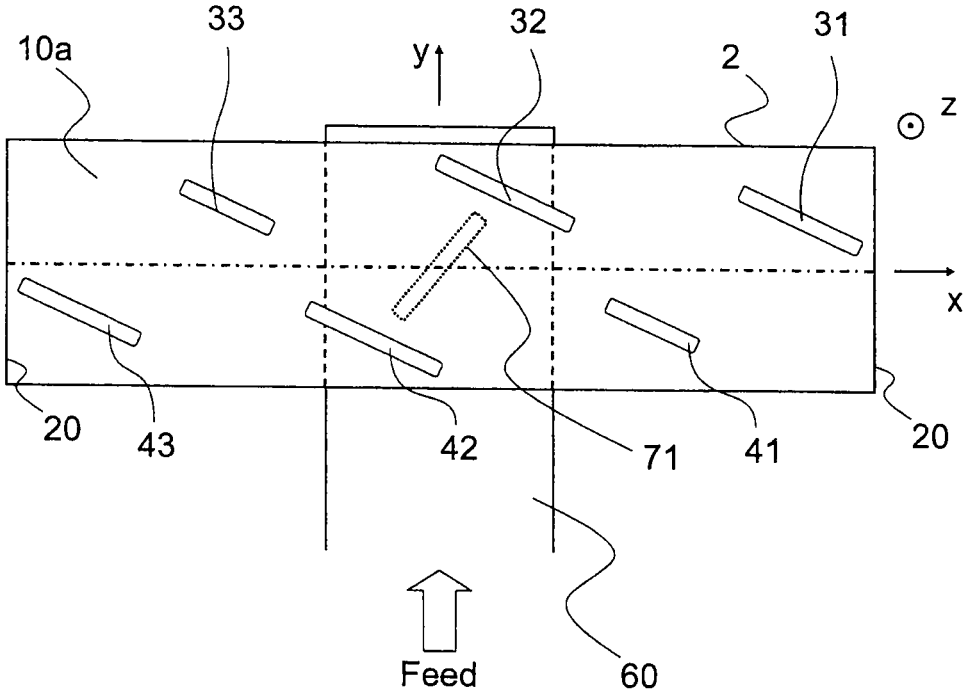
FIG. 13 is a diagram illustrating another configuration of the waveguide slot array antenna apparatus according to Embodiment 4 of the present invention.

Also, in FIG. 12, the waveguide slot array antenna 2 whose both ends are short-circuited and the feeding waveguide 60 are arranged in parallel so that the tube axial directions thereof coincide with each other. Alternatively, as illustrated in FIG. 13, the respective waveguides may be arranged such that the orientations of the tube axes thereof may be orthogonal to each other on the x-y plane. In this case, the orientation of the coupling slot 71 is rotated as appropriate from the tube axes of the respective waveguides so as to change the degree of feeding electricity from the feeding waveguide 60 to the waveguide slot array antenna 2 whose both ends are short-circuited, to thereby enable alignment.

Figure 14:
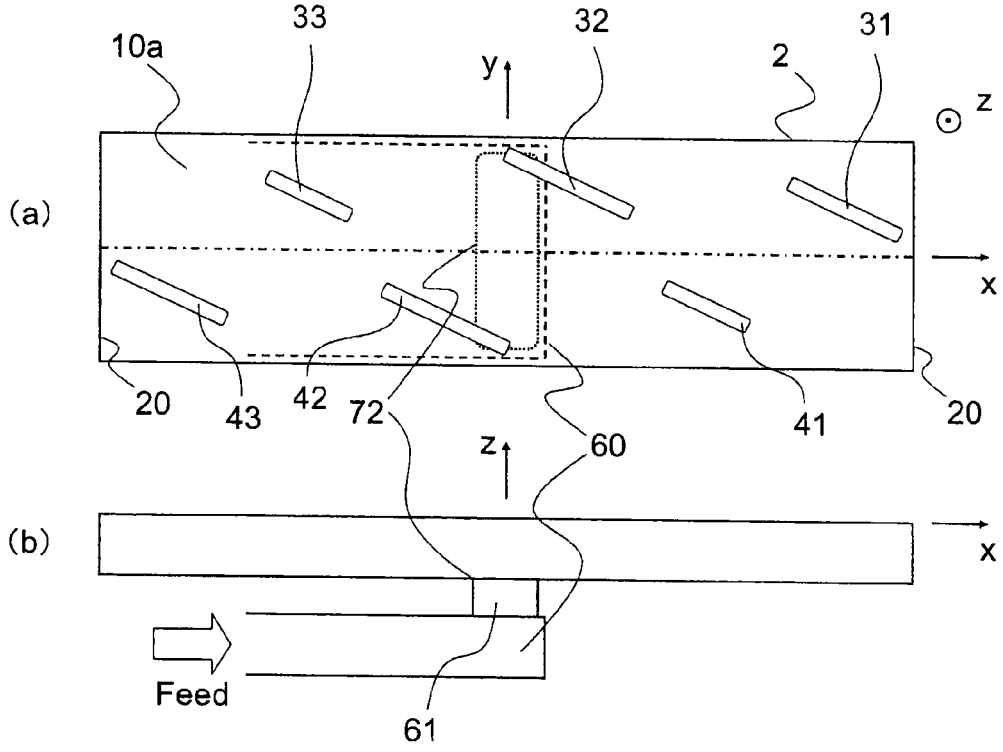
FIG. 14 are diagrams illustrating further another configuration of the waveguide slot array antenna apparatus according to Embodiment 4 of the present invention.

Further, in FIGS. 12 and 13, the coupling slot is formed between the waveguide slot array antenna 2 whose both ends are short-circuited and the feeding waveguide 60. Alternatively, as illustrated in FIG. 14, the coupling portion may be configured by a coupling hole 72 that is a coupling opening portion formed in the waveguide slot array antenna 2 and a bent tube 61 that is a coupling tube which is formed in the feeding waveguide 60 and is coupled with the coupling hole 72 of the waveguide slot array antenna. FIG. 14(*a*) is a front view of the wide plane side provided with the slots of the waveguide slot array antenna apparatus according to this example, and FIG. 14(*b*) is a bottom view of FIG. 14(*a*). As illustrated in FIG. 14, the waveguide slot array antenna 2 whose both ends are short-circuited and the feeding waveguide 60 are arranged in parallel so that the tube axial directions thereof coincide with each other. Also, the feeding waveguide 60 is provided with a bent structure formed of the bent tube 61 obtained by bending the leading end of the feeding waveguide 60 in an E-plane direction. The bent tube 61 is coupled and connected with the coupling hole 72 formed in the waveguide slot array antenna 2 whose both ends are short-circuited. Apart from this structure, the feeding waveguide 60 may be arranged such that, as illustrated in FIG. 13, the tube axis thereof is orthogonal to the tube axis of the waveguide slot array antenna 2 whose both ends are short-circuited on the x-y plane.

Embodiment 5

Figure 15:
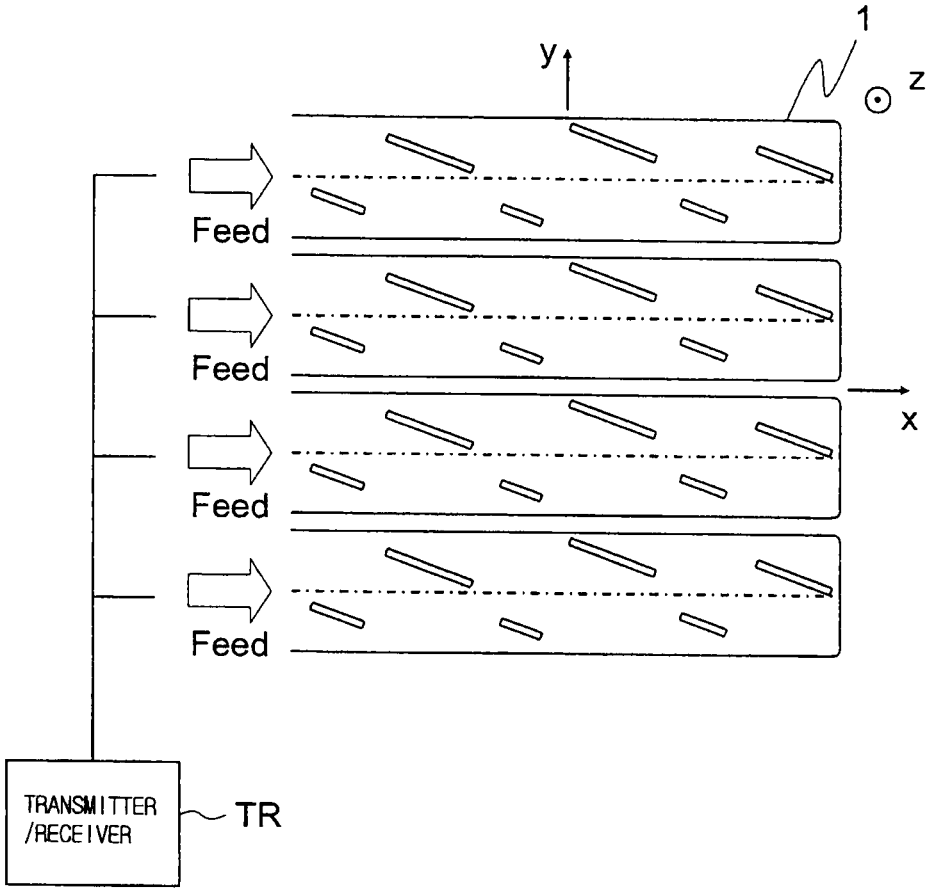
FIG. 15 is a diagram illustrating a configuration of a waveguide slot array antenna apparatus according to Embodiment 5 of the present invention.

FIG. 15 is a front view of a waveguide slot array antenna apparatus according to Embodiment 5 of the present invention on the wide plane side on which slots are formed. In FIG. 15, the waveguide slot array antenna 1 illustrated in FIG. 1 or FIG. 5 is configured as one sub-array, and a plurality of the sub-arrays are arranged in parallel, so that the wide planes provided with the slots are arranged in parallel such that the tube axial directions are parallel to each other in the same direction, to thereby provide the waveguide slot array antenna apparatus. As illustrated in FIG. 15, an array antenna having an arbitrary opening diameter may be realized by using the respective waveguide slot array antennas 1.

As the feeding method for the array antenna, as illustrated in FIG. 15, there may be employed a configuration in which feeding ports (indicated by the arrows "Feed") are, independently provided for each of the waveguide slot array antennas 1, and the feeding ports are connected to a transmitter/receiver TR such as a feeder which is additionally provided. With this construction, there may be realized the waveguide slot array antenna apparatus in which each of the waveguide slot array antennas 1 form one channel, and the respective channels are excited in phase, or a phase difference is set between the channels and excited to scan the main beam direction of the array antenna at an arbitrary angle on the Y-Z plane. Also, when the waveguide slot array antenna apparatus according to this embodiment is used for a receiving device, the phase difference of the electric waves received by the respective channels may be checked so as to estimate the arrival angle.

As another configuration of the array antenna different from the above, a branching structure of the waveguide, for example, an H-plane T-branch structure may be used, so that some or all of the respective feeding portions in FIG. 13 are brought together. As one example, in the structure of FIG. 13, a branch structure of a tournament shape including two tiers of the H-plane T-branch structures may be connected to the feeding portion of the respective waveguide slot array antennas 1, so that the feeding ports to the feeding device may be integrated into one.

Figure 16:
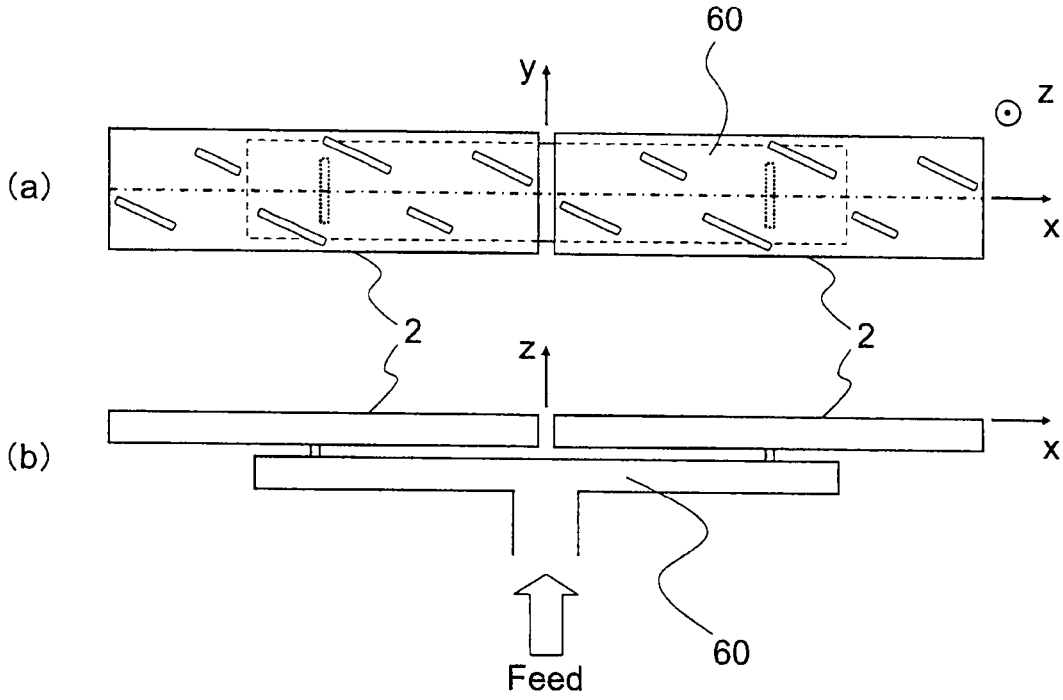
FIG. 16 are diagrams illustrating another configuration of the waveguide slot array antenna apparatus according to Embodiment 5 of the present invention.

As illustrated in FIG. 16, the waveguide slot array antenna 2 whose both ends are short-circuited illustrated in FIG. 12 is configured as one sub-array, a plurality of the sub-arrays are arranged in series, so that the tube axes are aligned on the same axes and the wide planes provided with the slots are directed toward the same direction, and the feeding waveguide 60 is coupled with the wide planes on the back surfaces of the respective waveguide slot array antennas 2 via the coupling portion. FIG. 16(*a*) is a front view of the waveguide slot array antenna apparatus according to this example on the wide plane side provided with the slots, and FIG. 16(*b*) is a bottom view of FIG. 16(*a*). The branch structure of the waveguide using the above-mentioned coupling portion may be applied to the feeding waveguide 60, to thereby realize the waveguide slot array antenna apparatus expanding in the tube axial direction of the waveguide (x-direction in the drawing). Also, three or more waveguide slot array antennas 2 may be coupled with one feeding waveguide 60. Further, the feeding waveguides and the waveguide slot array antennas may be increased in number and coupled with each other so that the waveguide slot array antenna apparatus may be expanded in the x-direction.

Figure 17:
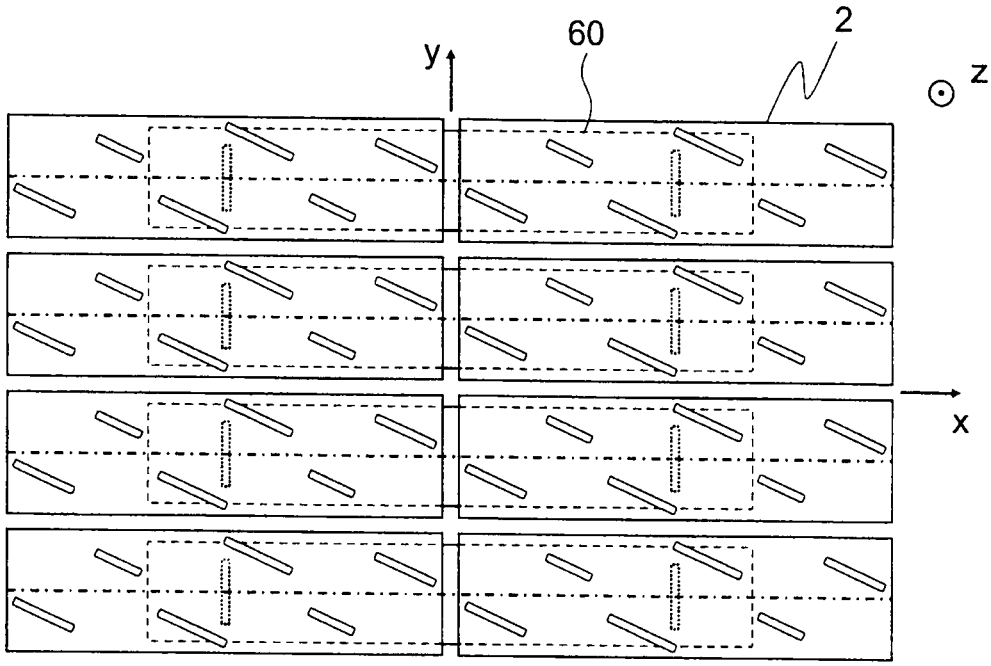
FIG. 17 is a diagram illustrating further another configuration of the waveguide slot array antenna apparatus according to Embodiment 5 of the present invention.

Further, as illustrated in FIG. 17, the waveguide slot array antenna apparatus may be expanded also in the y-direction. In the waveguide slot array antenna apparatus of FIG. 17, the waveguide slot array antenna apparatus illustrated in FIG. 16 is configured as a sub-array, and a plurality of the sub-arrays are arranged in parallel, so that the wide planes provided with the slots are directed toward the same direction and the tube axial directions are parallel to each other. Similarly, the waveguide slot array antenna apparatus may be easily configured by the branch structure of the feeding waveguide 60. Alternatively, three or more waveguide slot array antennas 2 coupled with one feeding waveguide 60 may be configured as a sub-array, and a plurality of the sub-arrays may be disposed in parallel.

It is needless to say that the present invention includes the possible combinations of the above respective embodiments.

Industrial Applicability

The waveguide slot array antenna apparatus according to the present invention may be applied to various fields.

The invention claimed is:

1. A waveguide slot array antenna apparatus, comprising a waveguide slot array antenna formed of a rectangular antenna waveguide which has a rectangular section orthogonal to a tube axis, wherein:

the rectangular antenna waveguide has one end side thereof in a tube axial direction serving as a feeding port and another end side short-circuited;

the antenna waveguide has a plurality of slender rectangular opening portions for radiating or receiving an electromagnetic wave arranged at intervals of about $\lambda g/2$ ($\lambda g$ is an intra-tube wavelength) along the tube axis on a first wide plane of a pair of wide planes that are parallel to the tube axis;

the plurality of slender rectangular opening portions each have the same predetermined angle with respect to a center line parallel to the tube axis of the first wide plane;

the slender rectangular opening portions adjacent to one another are alternately arranged at opposite positions with respect to the center line;

the slender rectangular opening portions located on one side with respect to the center line of the first wide plane each have a length longer than about $\lambda f/2$ ($\lambda f$ is a free space wavelength), and the slender rectangular opening portions located on another side each have a length shorter than about $\lambda f/2$;

at least one waveguide slot array antenna including an antenna joint waveguide configured so that two of the rectangular antenna waveguides are joined at positions of respective feeding points in opposite directions so as to align the respective tube axes and having both ends thereof short-circuited; and one feeding waveguide disposed on a second wide plane side of the pair of wide planes of the waveguide slot array antenna, wherein:

the feeding waveguide is coupled with the second wide plane of the antenna joint waveguide via a coupling portion, wherein the coupling portion comprises a coupling opening portion formed in each of the waveguide slot array antenna and the feeding waveguide, or a coupling opening portion formed in the waveguide slot array antenna and a coupling tube formed in the feeding waveguide and coupled with the coupling opening portion of the waveguide slot array antenna.

2. The waveguide slot array antenna apparatus according to claim 1, wherein:

a plurality of the waveguide slot array antennas are arranged in series so that the tube axes thereof are aligned on the same axis and the first width planes are directed toward the same direction; and the feeding waveguide is coupled with the second wide planes of the respective waveguide slot array antennas via the coupling portions.

3. The waveguide slot array antenna apparatus according to claim 2, wherein:

the plurality of the waveguide slot array antennas and one feeding waveguide are configured as one sub-array; and a plurality of the sub-arrays are arranged in parallel, so that the first wide planes are directed toward the same direction and the tube axial directions are parallel to each other.

4. The waveguide slot array antenna apparatus according to claim 1, wherein a distance between a short-circuiting plane of the short-circuited end of the waveguide slot array antenna and a slender rectangular opening portion adjacent to the short-circuiting plane is an odd multiple of about $\lambda g/4$.

5. The waveguide slot array antenna apparatus according to claim 1, wherein the rectangular antenna waveguide and a feeding waveguide are each formed of a rectangular hollow metallic tube, and the plurality of slender rectangular opening portions are formed of slots formed in the rectangular hollow metallic tube.

6. The waveguide slot array antenna apparatus according to claim 5, wherein the rectangular hollow metallic tube is filled inside with a dielectric material.

7. The waveguide slot array antenna apparatus according to claim 1, wherein:

the rectangular antenna waveguide and a feeding waveguide each comprise a rectangular dielectric board which has a copper foil portion formed on opposed wide planes and an end surface of at least one of both sides in the tube axial direction, which is orthogonal to the tube axis, and in which a plurality of through-holes subjected to metal plating, which pass through the rectangular dielectric board and electrically connect the copper foil portions on both sides, are formed along both sides of the center line of the wide plane; and the plurality of slender rectangular opening portions are formed of grooves formed by removing copper foil of the copper foil portion.

* * * * *